United States Patent [19]

Mantey et al.

[11] 4,155,703

[45] May 22, 1979

[54] LINING TRUNCATED CONE WALLS BY MEANS OF REFRACTORY BRICKS

[75] Inventors: Paul G. Mantey, Amberg; Hans G. Fassbinder; Georg Babilon, both of Sulzbach-Rosenberg, all of Fed. Rep. of Germany

[73] Assignee: Eisenwerk-Gesellschaft Maximillianshutte mbH., Sulzbach-Rosenberg, Fed. Rep. of Germany

[21] Appl. No.: 770,348

[22] Filed: Feb. 22, 1977

[30] Foreign Application Priority Data

Feb. 25, 1976 [DE] Fed. Rep. of Germany ..... 2607598

[51] Int. Cl.[2] ..... F27D 1/14; F27D 1/16

[52] U.S. Cl. ..... 432/3; 432/252; 432/248; 266/280; 52/249

[58] Field of Search ..... 432/3, 247, 248, 252, 432/250, 251; 52/246, 247, 249; 266/280, 281, 283, 286; 13/35; 264/30; 110/1 R, 1 A, 1 B, 1 L, 99 R

[56] References Cited

U.S. PATENT DOCUMENTS

| | | | |
|---|---|---|---|
| 1,123,874 | 1/1915 | Hemmer | 432/247 |
| 1,237,282 | 8/1917 | Bergman | 432/248 |
| 1,563,038 | 11/1925 | Naismith | 432/248 |
| 2,024,595 | 12/1935 | Petit | 432/247 |
| 2,319,065 | 5/1943 | Karmanocky | 432/252 |
| 2,850,891 | 9/1958 | Scheib | 432/247 |
| 2,901,990 | 9/1959 | Hütter | 266/280 |
| 3,048,481 | 8/1962 | Eastman | 266/281 |
| 3,272,490 | 9/1966 | Ross | 266/280 |
| 3,295,845 | 1/1967 | Finn | 52/249 |
| 3,315,950 | 4/1967 | Potocnik et al. | 432/252 |
| 3,350,085 | 10/1967 | Over | 266/283 |
| 3,521,870 | 7/1970 | Lewis et al. | 13/35 |

*Primary Examiner*—Henry C. Yuen

*Attorney, Agent, or Firm*—Lawrence I. Field

[57] ABSTRACT

The lining of conically narrowing or widening walls with brick is facilitated by laying the brick in courses which are closed rings, the bricks subtending an angle of about 5° to 30° with respect to the horizontal.

19 Claims, 4 Drawing Figures

LINING TRUNCATED CONE WALLS BY MEANS OF REFRACTORY BRICKS

The invention relates to lining conically narrowing or widening cylindrical walls, that is, walls in the shape of truncated cones, by means of commercially available refractory stones or bricks, without the necessity of using assembly accessories, for instance planking.

In many metallurgical and non-metallurgical facilities, vessels are provided with a refractory lining when used for high temperature processes so as to protect their steel construction. This is the case for virtually all refining and transporting vessels employed in metallurgical processes. In the steel industry, the refining vessels, such as the oxygen blown convertors, are provided with wall linings of two or more layers and of a total thickness up to about 1 meter.

Conventionally the cylindrical regions of these refining vessels are lined with rings of bricks, consisting of suitable wedge-shaped bricks e.g. the so-called end arch bricks, which are of equal or different wedge angles. These rings of bricks line the hot side of the vessel and form the wear layer which is ordinarily form 300 to 750 mm thick. On or two further layers of refractory of varying wall thicknesses are located ordinarily behind the aforesaid rings to protect the steel portions of the vessel, e.g. a supporting shell or casing. A permanent lining is immediately against the steel casing, and frequently there is an additional layer, preferably in tamped form, between the permanent lining and the wear layer.

Ordinarily the conical wall portions of these steel refining vessels, for instance the convertor hood where the steel casing narrows at a slope from 20 to 40°, are also lined with horizontal rings of bricks which assume a smaller diameter from one course of bricks to the next course of bricks. This creates steps depending in magnitude both on the slope of the wall and on the height of the bricks. For a conventional brick height of 130 mm add a sloping angle of 30°, the widths of the steps from one ring to the next ring are about 75 mm.

Linings of specially shaped bricks are known for these conical wall regions, which avoid such steps. These tapered bricks are so laid that they are parallel to the slope of the wall, so that the joints of the rings are perpendicular to the wall, whereby they correspond to the annular brick arrangement in circular walls. However, then the inclinations of the walls are more pronounced, for instance if they are 30° and more, laying these specially formed bricks requires an assembly acessory, for instance, planking. The latter becomes superfluous only after closing the rings when sufficient stability is achieved. This construction using specially formed bricks suffers from the further drawback that these bricks are relatively expensive to manufacture since they require wedge shapes on two surfaces, one to form a ring and again in a direction perpendicular thereto so that the vertical seams between the bricks remain closed.

The partly conically joining walls of the asymmetric basic Bessemer steel convertors have been lined for instance with appropriately shaped bricks but without assembly structures. The wall inclination changing over the periphery of this asymmetric convertor shape, the convertor is rotated when the hood is being lined, so as to avoid the use of planking while lining the hood.

The lining of conical walls with horizontal rings or bricks and the resulting steps is the most economical lining method of the present state of the art because expensive specially shaped bricks and planking are eliminated. However, steps with increasing step-widths cause premature wear because of the breakage of the brick ends. Frequently spalling of the brick tips takes place during the very first initial heating of the convertor lining when the convertor is being placed in operation with a new lining. This is especially the case when low priced tar-bonded bricks are used rather than ceramically bonded bricks.

The invention therefore is addressed to creating a method for lining conically narrowing or widening walls, that is, conically truncated cones which method eliminates marked steps even for wall inclinations larger than 20° and also the spalling of bricks, (which are commercially available wedge shaped bricks), and which further eliminates the use of assembly structures when the bricks are laid.

The invention solves this problem by lining the conically narrowing or widening walls with commercially available, wedge-shaped bricks laid in courses which are closed rings or in closed similar shapes, said bricks subtending on angle of about 5 to about 30° with respect to the horizontal. The slope of the rings of bricks constituting the vessel lining and that of the wall, for instance, of the steel casing of a convertor, may be different. Preferably the slope of the rings of bricks is less than that of the wall or casing.

For heights of such rings or of such wedge bricks between 50 and 150 mm, which are preferred in the application of the method of the invention, the maximum width of step between two adjacent rings of bricks is 50 mm. Surprisingly it was found in empirical operational tests and in corresponding laboratory research that spalling can be eliminated both when heating up and in operation, provided the width of step is not more than 50 mm maximum. Very possibly this is due to the fact that in the aforesaid brick cross-sections consisting of brick with heights between 50 and 150 mm and brick widths of up to about 150 mm on the narrow side, cracks due to stress caused for instance by heat cycling do occur most readily at depths from 60 to 80 mm. Cracks at these depths, (measured from the hot side) no longer cause dropping of the spalled brick heads because there are still supported by the adjacent layer of bricks. The moment the region of the cracks falls within the width of the steps, as is the case in the presently known stepped designs, the spalled brick heads fall out of the annular bond.

For instance in the known design, for a wall slope of 40° and the conventional step height of 100 mm, the step width is about 84 mm. When applying the method of the invention and employing a 20° slope in the brick rings, the step width is only about 36 mm for the same wall slope and brick height. This makes clear why the brick heads drop off in the known design, whereas they still remain fastened in the arrangement of the invention.

When lining truncated cone walls or similar structures with rings of wedge-shaped bricks, mounted at an angle to the horizontal, the vertical seams or joints between the bricks are open in the shape of wedges. These wedge-shaped openings and particularly the base of the wedge, depends on the slope of the brick, on its height and on the number of bricks in the ring.

Surprisingly no difficulties were encountered in practical operation when permitting a wedge-shaped opening of the vertical joints up to a base magnitude of 10 mm maximum. Preferably these rings of bricks are laid with a conventional, compatible mortar. This mortar then fills the joint space. Thus magnesite mortar with sulfate, phosphate and chromic acid bonds was found practical when laying magnesite bricks. Dry joint fillers or non-aqueous mortars based on dolomite or magnesite powder combined with tar are used when lining with dolomite bricks. Again, if the lining is constructed without filling the joints with fillers or mortar, no difficulties are encountered in practice.

While laying bricks with unilaterally opening vertical joints without using joint fillers does lead to the melt penetrating the joints in the region of the molten metal bath in metallurgical vessels so lined, nevertheless no premature wear will result thereby. Ordinarily the melt solidifies in these relatively small wedge-shaped joints and fills them. Thus it was found in an oxygen convertor for steel manufacture following operation that there was steel in the wedge-shaped joint spaces. It appeared that the solidifed steel melt contributed to holding in position the brick ends already spalled by means of cracks from the surface of the brick, that is, the gripping of the bits of brick by the solidifed melt prevented said bits from being carried away or dropping off. It is therefore the sense of the invention that vertical joints opening in the shape of a wedge be allowed in whole or in part in the rings of bricks. Each particular manner of use must be determined on the basis of the quality or nature of the brick and its joint width, the sloping angle of the rings of bricks, whether joint fillers should be used at all, and if so, to what extent.

When using tar-bonded refractory bricks, joint fillers are easier to omit than when using ceramically bonded, tar-impregnated bricks of the same grade. When being heated, tar-bonded bricks pass through a temperature range in which they may be plastically shaped. Because of thermal expansion of the refractory material, the bricks deform and at least in part fill the open wedge-shaped joint. This provides another advantage, namely such measures to absorb the thermal expansion, for instance expansion joints such as cardboard inserts and similar materials are no longer required.

On account of the surprising discovery that actual practice allows wedge-shaped open joints in the rings of bricks lining the convertor at an angle without thereby incurring a drawback, specially formed bricks for lining truncated cone walls may be dispensed with. Commercially available wedge bricks, for instance end arch bricks can be used, which normally are employed for lining horizontal rings of bricks. Furthermore no restriction is involved regarding the refractory material, that is the quality of the refractory substances.

Thus the conventional basic refractory substances such as magnesite, dolomite, chrome magnesite, and mixtures, that is, also mixed linings, have been found practical for instance in steel production convertors when laid in accordance with the method of the invention.

Another significant teaching of the method of the invention is that commercially available, wedge-shaped bricks sloping from 5 to about 30° to the horizontal and mounted in closed circles or closed similar shapes can be laid and are laid without having to resort to assembling structures such as planking for example. This is a decisive advantage when dealing in large scale industrial applications. Thereby the lining procedure becomes as simple as the laying of horizontal rings of bricks, and the time and expenditure of setting up planking are saved. It was found in actual practice that even when using mortar, the bricks surprisingly do not slip on their support up to an inclination of 30°, but that rather they remain in the laid and desired position even when the ring of bricks is incomplete.

When building the bricks into the rings of bricks inclined to the horizontal, the brick friction exceeds the down slope from component. Clearly the friction depends on the nature and the surface of the refractory bricks, as regards tar-impregnated bricks with relative smooth surfaces, friction is less than in the ordinary magnesite bricks lacking tar impregnation. Surprisingly tar-impregnated bricks provide frictions exceeding the down slope force components as long as the inclination of the rings of bricks with respect to the horizontal does not exceed 30°, preferably 25°. Only such inclinations with respect to the horizontal are permitted by the invention for the rings of bricks for which friction exceeds the down slope force component.

Adapting the sloped lining rings to the lining of truncated cone wall constructions at the cylindrical wall segments ordinarily is achieved by a ring of appropriate, shaped bricks with a predetermined slope. It was found furthermore that from one to five adaptation layers of correspondingly cut or shaped bricks be used as a transition zone from the horizontal to the inclined rings of bricks. Thus in an actual installation, adaptation of rings of bricks sloping at 20° to horizontal ones was desired. However the maximum level of 10° could be cut from the available bricks of 500 mm length and 100 mm height. To achieve the desired slope of 20°, two cut rings of bricks each sloping by 10° were used as the transition layer.

The invention will be better understood from the description taken in conjunction with the drawings in which:

FIG. 1 illustrates the lining region of steel producing convertor.

Figure 1:
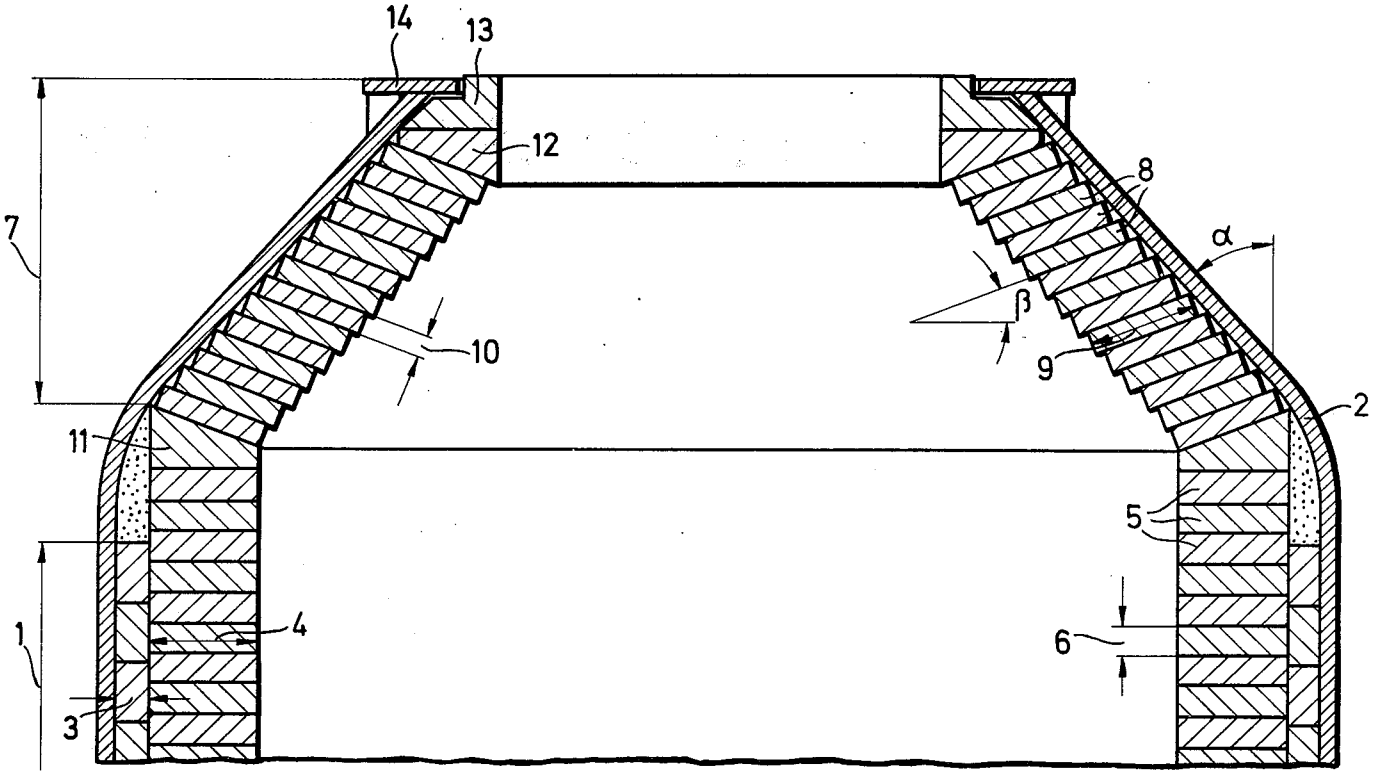
FIG. 1 is a vertical section of part of a convertor illustrating a lining with horizontal rings of bricks and slopingly built in rings of bricks.

The convertor includes a steel plate casing 2, a so-called permanent lining 3, and a wear lining 4 for the cylindrical portion 1 of the convertor. In one installation, consisting of horizontal rings 5 of bricks the thickness of lining 4 is 500 mm, and the height 6 of the bricks in each of rings 5 is 130 mm. Steel casing 2 changes from a cylinder 1 to a truncated cone shape in the upper region of the convertor, the hood 7, and in FIG. 1 the casing 2 slopes at about $\alpha = 45°$, as shown.

The truncated cone hood 7 is lined with rings 8 of bricks laid at a slope with reference to the horizontal and made from commercially available, wedge-shaped bricks. In the convertor of FIG. 1 the hood lining thickness 9 is 450 mm, the brick height 10 is 100 mm., and the sloping angle $\beta$ of the rings of bricks is 20°. The sloping rings of bricks 8 are joined to the horizontal rings of bricks 5 by means of a ring of wedge-shaped bricks 11. This ring 11 of shaped bricks predetermines the slope $\beta$ of 20° for the rings of bricks 8 incorporated at the inclination of the upper face of the bricks of ring 11.

Shaped bricks 12 are incorporated as a termination of the convertor hood lining and serve to provide terminal convertor ring of bricks 13 with a horizontal base on which ring 13 is laid. The bricks of the terminal convertor ring 13 line the mouth of the convertor and protect convertor flange 14 welded to casing 2. Because the ring 12 of wedged bricks and that of convertor termination 13 act in concert, a stable lining without steps is achieved in this heavily stressed region of the convertor lining. It is one of the advantages of the method of the invention to provide the arrangement of bricks for the convertor end as shown in FIG. 1.

Figure 2:
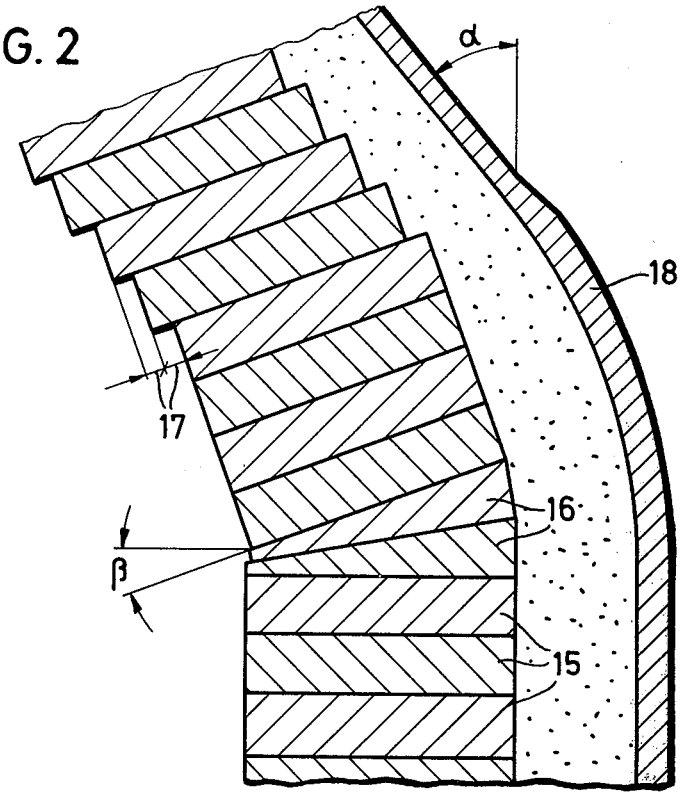
FIG. 2 is a vertical section of part of a convertor illustrating a lining with two adaptation rings of shaped bricks to achieve the desired slope of other rings of bricks.

As regards a steel producing convertor in which the oxygen is blown by the so-called OBM/Q-BOP process for the bottom tuyeres into the melt, e.g. as described in U.S. Pat. Nos. 3,706,549 and 3,771,998 and others of a similar nature, the lining consisted of ceramically bound, tar-impregnated magnesite bricks in the lower conical portion of the convertor and in the center, cylindrical portion of the convertor. Initially the upper, conical segment of the convertor in the shape of a truncated cone and of a slope of 40° was lined with tar-bonded magnesite bricks in the form of stepped horizontal rings of bricks. At a slope of 40° the width of the steps is about 84 mm. When heating, that is upon starting operation, most of the brick ends of the convertor hood broke off with the result that the hood lining was soon worn down to half of the wall thickness of 450 mm. In order to avoid this excessive premature wear, the refractory lining of the convertor hood was made in conformity with the method of the invention as shown in FIG. 2. In this embodiment two rings of shaped bricks 16 each sloping at 10° were placed on the horizontal rings 15 of bricks laid as the lining in the cylindrical portion of the casing 2. Then followed first four stepless rings of bricks sloping at the angle $\beta$ determined by the slope of the two rings 16 of shaped bricks. The remaining rings of bricks to the mouth of the convertor were laid with stepping 17 of about 36 mm in order to compensate the 20° slope of the rings of bricks and the 40° slope of the truncated cone wall, respectively $\beta$ and $\alpha$. When using the same tar-bonded, magnesite bricks in the lining, the construction shown in FIG. 2 proved to be widely superior to the previously known, stepped construction. No spalling occurred when heating. The permanent lining and a tamped layer about 100 mm thick occupy the space between the brick rings and the steel casing 18, the tamped layer for instance consisting of tar bonded dolomite; the permanent lining is eliminated in the sloping region of the hood, and only the 100 mm thick tamped layer is utilized for compensation.

Figure 3:
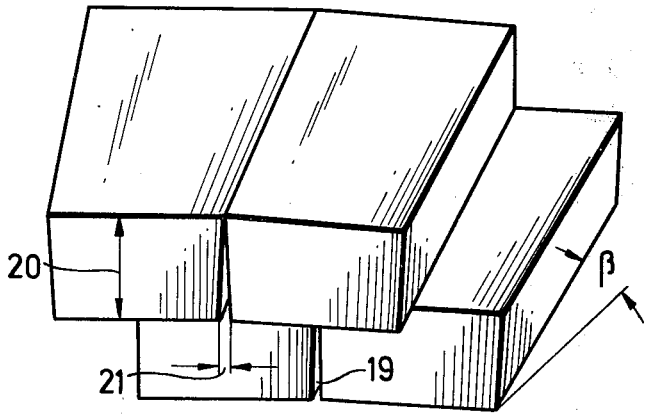
FIG. 3 is a view in perspective of a portion of the lining of the convertor as seen inside of the convertor showing slopingly mounted rings of bricks with vertical joints opening like wedges.

FIG. 3 is a perspective depicting the opening of the vertical joints 19 in sloping rings of bricks. Thus for an angle $\beta = 20°$ and height of 100 mm of bricks 20 and for a closed ring of 75 bricks, the width of the base 21 of the joint 19 opening like a wedge is about 3 mm. When using the aforesaid lining of the truncated cone wall with tar-bonded magnesite bricks, tar-bonded commercially available magnesite mortar was used in one instance, filling the wedge-shaped and all other joints, while in a second installation, the bricks were laid entirely without joint fillers or mortar. Both installations exhibited the same good durability and a lack of spalling of the brick ends.

Figure 4:
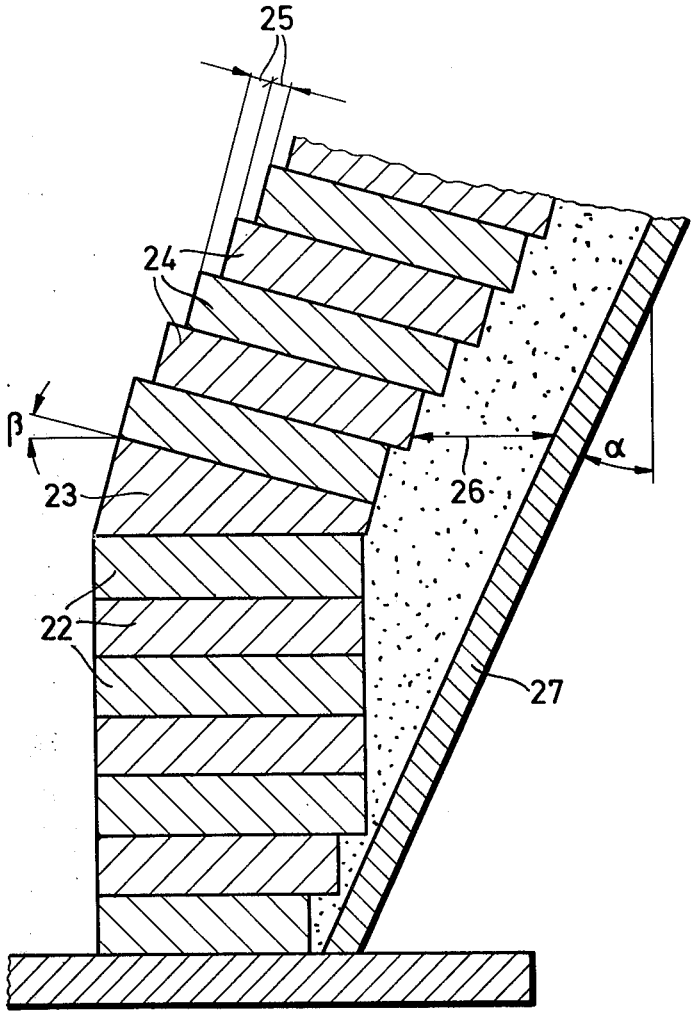
FIG. 4 is a vertical section through a furnace wall showing a lining with sloping and conical rings of bricks, said lining being arranged in reverse of the linings shown in FIGS. 1 and 2.

FIG. 4 illustrates the application of the method of the invention to a conic wall design the reverse of that in FIGS. 1 and 2. In this embodiment the wall slope $\alpha = 25°$ and that of the rings of bricks is $\beta = 15°$. The shaped bricks 23 predetermining the slope rest on the horizontal rings 22 of bricks, and above that the inclined rings 24 of bricks with a step width of about 26 mm. The spacing 26 between rings 24 and the steel casing 27 is provided for the permanent lining and for a tamped layer in order to correct the inclined rings to the permanent lining. Rings 22, 24 may be laid directly against the steel plate 27. The vertical joints of rings 24 open upward like wedges.

The sense of the invention is the appropriate and deliberate modification of the conventional method for lining structures with truncated cone wall designs with linings of refractory bricks and is not intended to be limited to the lining of convertors or refining vessels for metallurgical purposes as described in the above examples which are given merely by way of illustration of preferred embodiments. The method applies also to the refractory linings of transporting vessels and furthermore to holding and bell furnaces making use of brick annuli.

Consequently, it is not intended that the invention be limited except as may be required by the appended claims.

We claim:

1. A lining for a furnace constructioned in the shape of a truncated cone comprising:

successive courses of wedge-shaped bricks disposed at a slant with respect to the horizontal and arranged annularly, said bricks having generally planar sides and generally planar top and bottom faces, and a wedge-shape in plan view, wherein said planar top and bottom faces are laid at an angle of slant which is between 5 and 30° with respect to the horizontal and wherein side faces of abutting bricks are essentially vertical.

2. The lining as defined in claim 1 wherein the bricks in each course are laid with an open vertical joint (19) between adjacent wedge shaped bricks of each course (8, 24) open at most by 10 mm to one side.

3. A lining as defined by claim 1 characterized in that the angle $\beta$ with respect to the horizontal of said courses of bricks (8, 24) differs from the angle $\alpha$ of the truncated conical furnace wall (2).

4. A lining as defined in claim 3 wherein the angle is less than the angle $\alpha$.

5. A lining as defined in claim 1 including a mortar in the joints (19) between the bricks of said courses of bricks (8, 24).

6. A lining as defined by claim 1 including in addition a ring of bricks having a sloping upper face upon which the brick in the lowermost of said courses of wedge shaped brick rest.

7. A lining as defined in claim 6 including in addition a terminal brick ring (13) at the top of said successive courses of brick.

8. A lining as defined in claim 1 wherein the height (10) of the individual brick in said courses is at most 150 mm.

9. In a vessel having a casing including a vertical wall portion and a truncated conical wall portion slanting with reference to the vertical at an angle $\alpha$, an improved method for instaling a brick lining in the truncated cone walls of said vessel which comprises:

laying at least one course of shaped bricks having generally planar front and back faces and having generally planar side faces and generally planar top and bottom faces and having a wedge shape in a section taken perpendicular to said top and bottom faces and extending from the front face of said brick to the back face of said brick with the top faces of said bricks sloping at an inclination $\beta$ with respect to the horizontal, said course being laid to form a ring within the periphery of said vessel adjacent to the base of said truncated cone wall;

and thereafter laying a plurality of courses of commercially available wedge shaped bricks having generally planar side faces and generally planar top and bottom faces and having a wedge shape in top plan view, each of said bricks being laid so that its bottom surface rests on the face of the previously laid next adjacent course beneath it, each of said plurality of courses being arranged in a closed ring, and the abutting side faces of the brick in said plurality of courses being vertical, the bricks in any one course of said plurality of courses being laid offset with reference to the bricks of the next adjacent course to provide an overhang at one end of each brick in said course thereby creating a step at said end of said brick in a section taken perpendicular to said top and bottom faces and extending from the front face of said brick to the back face of said brick.

10. The method as defined in claim 9 wherein the width of said steps between the bricks of two adjacent rings of bricks is a maximum of about 50 mm.

11. The method as defined in claim 9 wherein the brick in said plurality of courses is laid so that vertical joints between any bricks and the next adjacent brick in said closed ring of the inclined bricks are open at one side of said joint up to a maximum of 10 mm.

12. A method as defined in claim 9 wherein the angle $\beta$ of the incline of said bricks in said plurality of courses of bricks with respect to the horizontal is different from the angel $\alpha$ of incline of the truncated cone wall which is being lined with a refractory brick lining.

13. A method as defined in claim 12 wherein the angle $\beta$ is less than the angle $\alpha$.

14. A method as defined in claim 9 wherein the height of the bricks in said plurality of courses is between about 50 mm and 150 mm.

15. A method as defined in claim 9 wherein the bricks of said lining comprise a basic refractory material selected from the group consisting of magnesite, dolomite, magnesite-chromium, and mixtures thereof.

16. A method as defined by claim 9 wherein the bricks of said lining are laid with conventional mortar as a joint filler.

17. A method for installing a brick lining in a vessel having truncated cone walls which comprises:

laying at least one course of shaped bricks with the bottom faces of the bricks in a horizontal plane and the top faces of the bricks sloping at an inclination between about 5° and 30° with respect to the horizontal, said course extending within the periphery of said vessel adjacent to the base of said truncated cone wall; and thereafter laying a plurality of courses of commercially available wedge shaped bricks, each of said bricks being layed so that its bottom surface and its top surface is inclined at an angle between 5° and 30° with respect to the horizontal, each of said courses being arranged in a closed circle and the abutting side faces of said brick are vertical.

18. In a vessel having a casing (2) including a verticall wall portion and a truncated conical wall portion slanting with reference to the vertical at an angle $\alpha$, an improved brick lining for the hot inside face of said truncated conical wall portion comprising:

at least one horizontal course of bricks (4,5) disposed horizontally in a closed ring within said vertical portion of said casing and supporting said lining;

a ring of wedge shaped bricks (11) laid on said horizontal course of bricks with the base of each wedge shaped brick being horizontal and the upper surface of each wedge shaped brick sloping at an acute angle $\beta$ with respect to the horizontal; and a plurality of successive courses of commercially available wedge shaped bricks laid on said ring of bricks, the bricks of said plurality of courses having generally planar sides and generally planar top and bottom faces and a wedge shape in top plan view; said bricks being laid in successive courses defining closed rings with the side walls of said bricks being laid vertical and the top and bottom faces of said bricks being laid inclined to the horizontal at said acute angle $\beta$, the bricks of successive courses being laid above the preceding course with an offset which provides an overhang at one end of each brick in said course thereby creating a step at said end of said brick, with reference to the brick in the next adjacent course.

19. The improved lining as defined in claim 18 wherein said bricks are laid so that the width of said step (17) between adjacent brick rings (8, 24) is 50 mm at most.

* * * * *